US006931663B2

(12) United States Patent
Horvath et al.

(10) Patent No.: US 6,931,663 B2
(45) Date of Patent: Aug. 23, 2005

(54) PROTECTIVE CLOTHING FOR ARMS, LEGS OR THE TORSO FROM A METAL RING BRAIDING

(76) Inventors: Heinrich Horvath, Schlattweg 15, 75447 Sternenfels (DE); Jörg Ritter, Hohlohstrasse 9, 76532 Baden-Baden (DE)

( * ) Notice: Subject to any disclaimer, the term of this patent is extended or adjusted under 35 U.S.C. 154(b) by 0 days.

(21) Appl. No.: 10/451,513

(22) PCT Filed: Dec. 17, 2001

(86) PCT No.: PCT/EP01/14878

§ 371 (c)(1),
(2), (4) Date: Jun. 20, 2003

(87) PCT Pub. No.: WO02/054897

PCT Pub. Date: Jul. 18, 2002

(65) Prior Publication Data

US 2004/0031079 A1 Feb. 19, 2004

(30) Foreign Application Priority Data

Dec. 20, 2000 (DE) ..... 100 64 923

(51) Int. Cl.[7] ..... F41H 1/02
(52) U.S. Cl. ..... 2/2.5

(58) Field of Search ..... 2/69, 2.5, 455, 2/456, 463, 464, 465, 467, 158, 159, 161.6; 428/52, 53, 54

(56) References Cited

U.S. PATENT DOCUMENTS

| | | | | | |
|---|---|---|---|---|---|
| 629,901 | A | | 8/1899 | Greenstreet | |
| 4,493,865 | A | * | 1/1985 | Kuhlmann et al. | 428/52 |
| 4,507,353 | A | | 3/1985 | Kuhlmann et al. | |
| 5,088,123 | A | | 2/1992 | MacDonald | |
| 5,511,241 | A | * | 4/1996 | Ziegler | 2/2.5 |
| 5,729,831 | A | * | 3/1998 | Kuhlmann | 2/16 |
| 5,858,054 | A | * | 1/1999 | Rosen | 66/202 |
| 5,894,602 | A | * | 4/1999 | Smith et al. | 2/159 |

FOREIGN PATENT DOCUMENTS

| | | |
|---|---|---|
| DE | 946523 | 7/1956 |
| DE | 2147830 | 3/1973 |
| DE | 7613451 | 9/1976 |
| DE | 3305841 | 9/1997 |
| FR | 9912028 | 3/2001 |

* cited by examiner

*Primary Examiner*—Gary L. Welch

(57) ABSTRACT

Protective clothing for arms, legs or the torso made from metal ring braiding that is reinforced in some sections. The interlaced rings are interlinked in a metal material fit in these sections.

13 Claims, 3 Drawing Sheets

PROTECTIVE CLOTHING FOR ARMS, LEGS OR THE TORSO FROM A METAL RING BRAIDING

The present invention relates to a protective clothing for arms, legs and the torso, made from a metal ring braiding.

Protective clothing made from a metal ring braiding is worn by persons handling tools, machines or objects that involve an especially great risk of injury, especially a cutting risk for the body, above all the limbs, as is the case, for example, in meat processing activities in slaughter-houses, the poultry and fish industry and when working with sharp-edged objects in the metal industry, to mention only a few of the applications of such protective clothing. Metal ring braiding has heretofore given good results in such applications, because it offers sufficient protection from injury, because it adapts itself readily to the body, due to its excellent flexibility, and because it does not hinder the movements of the body. The term metal ring braiding is meant to describe a metal braiding, built up from metal rings that are alternately and loosely wound around each other.

However, the high flexibility of the metal ring braiding is also connected with certain disadvantages, as will be seen from the example of a protection for the forearm that can be fastened on a glove in the form of a gauntlet. If that forearm protection consists of a metal ring braiding, it will collapse and telescope in the area of the wrist, unless a stiffening arrangement is provided that prevents the material from collapsing, for example by the arrangement of plastic or metal bars, or unless the forearm protection is made longer so that it will extend over the elbow where it can be fastened by a belt that is wrapped around the arm. Both solutions hinder, however, the movements of the arm.

In order to overcome that disadvantage it has been known from DE 33 05 841 C2 to stiffen a metal ring braiding by bands made from silicon or a plastic material in which strips of the metal ring braiding are embedded. It is, however, a disadvantage of that solution that such silicon or plastic bands complicate the cleaning and disinfecting processes for such protective clothing. In addition, such silicon or plastic bands are subject to heavy wear and abrasion in practical use.

DE-OS 2 147 830 discloses a protective clothing comprised of a scale-type braiding consisting of metallic ring links and cross-shaped scale links. The described arrangement is said to facilitate the cleaning process for the scale-type braiding. DE-PS 946 523 describes a stabbing protection apron consisting of metal braiding in which rings of stainless steel are connected by scale-shaped light metal connection elements with a view to reducing the weight of the metal braiding.

Now, it is the object of the present invention to provide a metal ring braiding for protective clothing for arms, legs and the torso, which is stiffened in part and which can be cleaned and disinfected more easily and can be produced at low cost.

This object is achieved by protective clothing having a metal ring braiding, wherein individual sections of the metal ring braiding are stiffened by interlaced rings interlinked by a solid metallic joint between the interlaced rings in the individual sections without the addition of further components to the protective clothing.

According to the invention, the metal ring braiding is stiffened by the fact that interlaced rings are linked by means of a metallic material fit in certain areas. This can be achieved, for example, by welding or soldering, the process of welding, especially pressure welding, for example point welding or roll welding, being cost-effective and especially preferred for this purpose. That measure provides the advantage that one can do without any non-metallic components in the protective clothing, so that the resulting protective clothing is easy to clean. The protective clothing according to the invention can by sterilised with advantage at high temperatures and can be exposed to aggressive chemical and mechanical cleaning means (washing agents, disinfectants, strong brushes) to which plastic materials would be too sensitive. The protective clothing according to the invention is especially insensitive to mechanical cleaning processes, and can be cleaned without any difficulty with the aid of high-pressure water jet cleaning equipment or steam jet cleaning equipment, for example. Advantageously, the invention also provides the possibility to stiffen individual sections of any desired geometry. This permits the metal ring braiding or the protective clothing, respectively, to be adapted in an advantageous way to the most diverse applications or uses.

Another advantage is seen in the fact that the metallic material fit between interlaced rings can be realised with little input, especially without any addition of further components to the protective clothing, so that the protective clothing can be produced at low cost. Advantageously, such protective clothing has a smooth surface, agreeable to wear, and especially the stiffened sections are reduced in thickness compared with the prior art, and no abrasion occurs.

An advantageous further development of the invention provides that the metallic material fit is produced by welding or soldering. This feature provides the advantage that the metallic material fit between interlaced rings can be achieved in this way at low cost.

An advantageous further development of the invention provides that each welding point connects four interlaced rings. This feature provides the advantage that it is thus possible to stiffen a given section with the least possible number of welding points.

An advantageous further development of the invention provides that the stiffened sections have the shape of strips. This feature provides the advantage that while the metal ring braiding can no longer telescope in the longitudinal direction of the strips, it will retain its desired high flexibility in a direction transverse to that longitudinal direction. The longitudinal direction of the strips most conveniently extends transversely to the longitudinal direction of the braiding. The metal ring braiding then can telescope to a considerable extent in the direction of feed, not however in the transverse direction. In the case of gloves, one therefore usually selects the feed direction so that it coincides with the longitudinal direction of the fingers, whereby the metal ring braiding is allowed to readily follow the movements of the fingers.

An advantageous further development of the invention provides that the dimension of the stiffened sections, especially the width of the strip-like stiffened sections, is equal to at least three times the outer diameter of the rings. This feature provides the advantage that the bending stresses acting on the stiffened strips are distributed over a larger number of welding points, which results in increased durability of the stiffening arrangement.

An advantageous further development of the invention provides that the sections are configured as interrupted strips. This feature provides the advantage that telescoping of the metal ring braiding in the longitudinal direction of the strips is avoided, while at the same time a certain degree of flexibility is maintained by the interruptions of the strips, whereby the wearing comfort of the protective clothing is improved.

An advantageous further development of the invention provides that the distance between neighbouring stiffened sections, that do not cross each other, is at least equal to twice the outer diameter of the rings of the metal ring braiding. This feature provides the advantage that the stiffened sections can be flexibly moved one relative to the other, whereby the wearing comfort of the protective clothing is maintained.

An advantageous further development of the invention provides that the outer contours of the protective clothing are stabilised. For certain applications, for example in the case of aprons, it is of advantage if the outer contours, i.e. the edges, are stiffened while the inner areas remain flexible.

An advantageous further development of the invention provides that the stiffened sections act to stabilise bulging structures. This feature provides the advantage that the protective clothing can be easily adapted to a person's shoulders or head, which increases the wearing comfort.

An advantageous further development of the invention provides that parallel strip-shaped sections or crossing strip-shaped sections are provided, depending on the particular application. In the case of crossing bands, the metal ring braiding is stiffened in two directions so that it will not telescope in any direction without hindrance. Such a braiding is suited above all for the protection of parts of the torso, for example as breast protection. In the case of non-crossing strips, the metal ring braiding will telescope in a direction transverse to the strips, and is highly flexible in this direction, similar to a non-stiffened metal ring braiding. Such a braiding is suited above all as protection for the arms or the legs. In an arm or leg protection, the strips preferably extend substantially in the longitudinal direction of the arms or legs in order to prevent telescoping of the braiding along the arms or legs even when the protection is not fixed on the arm or leg. The degree of stiffening of the braiding may be selected depending on the particular application and can be adjusted within broad limits by varying the distance, the width and the thickness of the stiffened strip-shaped sections.

Further features and advantages of the invention will be explained hereafter with reference to the example that follows. In the drawings.

Identical parts, or parts corresponding to each other, are identified in the different Figures by the same reference numerals.

The illustrated metal ring braiding 1 is built up from equal circular rings 2. In the braiding, each ring 2 is interlaced with four neighbouring rings; at the edges of the braiding and at seams formed with a view to adapting the form of the braiding to the contour of a part of a body, the degree of interlacing is of course lower.

Figure 1:
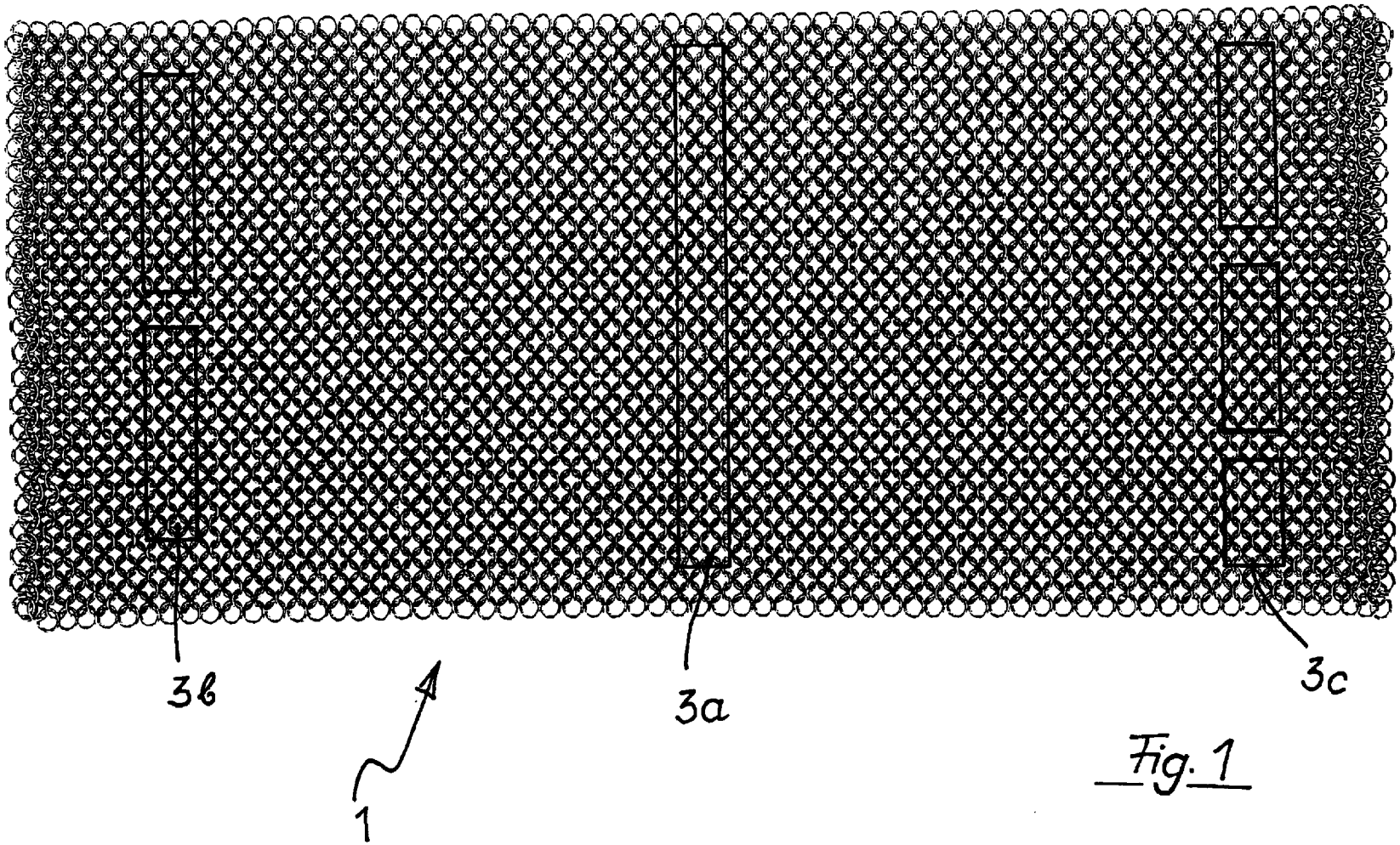
FIG. 1 shows a metal ring braiding with stiffened sections.

FIG. 1 shows a piece of a metal ring braiding 1, which is stiffened within sections 3*a*, 3*b*, 3*c* by the fact that interlaced rings have been connected one with the other in these sections 3*a*, 3*b*, 3*c* by a metallic material fit produced by pressure welding. While section 3*a* takes the form of a continuous strip, sections 3*b* and 3*c* are configured as interrupted strips, which provides the advantage of increased flexibility. There is of course also the possibility to stiffen sections of other shape, especially bent or crossing strips, in the metal ring braiding 1. The use of strip-shaped sections provides the advantage that the stiffened area can be kept small while still achieving the desired stiffening effect for the protective clothing. By keeping the stiffened area as small as possible, the production costs can be reduced and the wearing comfort can be improved. The strip-shaped sections 3*a*, 3*b*, 3*c* shown in FIG. 1 have a width equal to three times the ring diameter. There is of course the possibility to make these sections 3*a*, 3*b*, 3*c* narrower or wider. However, the wider the sections are made, the greater will be the loss in flexibility of the protective clothing and the sacrifice in wearing comfort. It the stiffened sections 3*a*, 3*b*, 3*c* are made narrower, the smaller number of welding points 4 will be subjected to correspondingly higher stresses. This may lead to breakage of welding points 4 or metal rings 2, and may impair the durability of the protective clothing.

Figure 2:
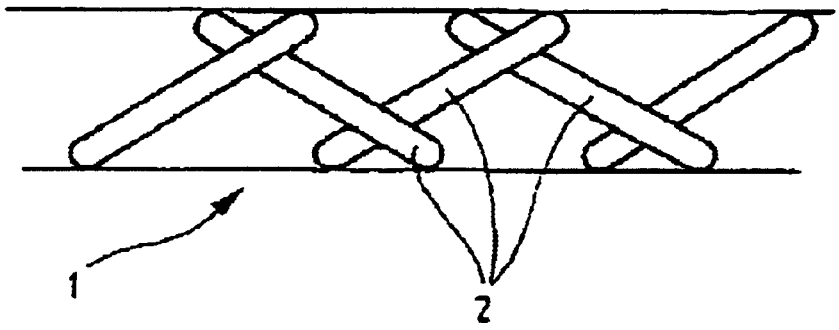
FIG. 2 shows a sectional side view of a non-stiffened metal ring braiding.
Figure 3:
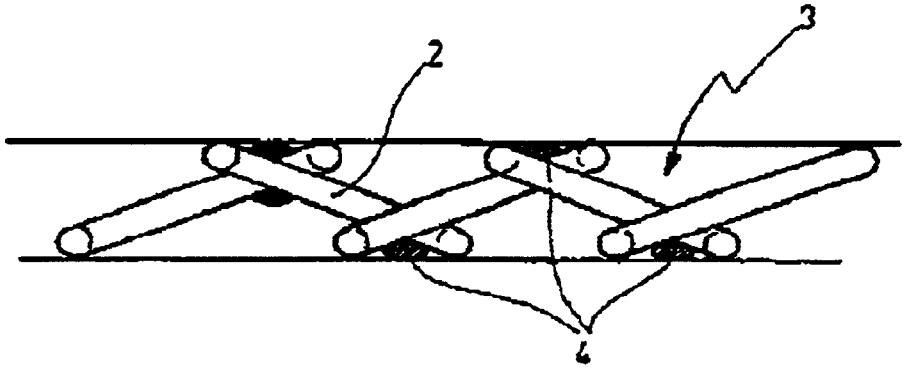
FIG. 3 shows a sectional side view of a stiffened section.

FIG. 2 shows a sectional side view of a non-stiffened metal ring braiding 1. FIG. 3 shows a corresponding section of a stiffened section 3. Stiffening is effected by pressure welding. As will become apparent when comparing FIGS. 2 and 3, this also has the effect that the metal ring braiding 1 becomes notably flatter in the stiffened sections 3*a*, 3*b*, 3*c*.

Figure 4:
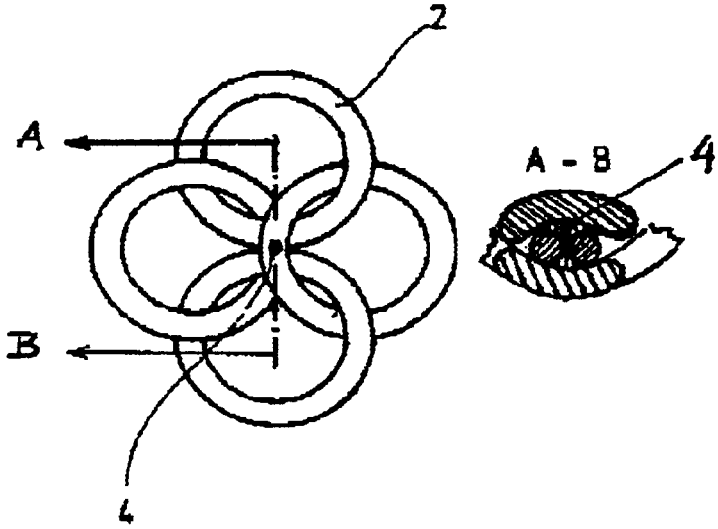
FIG. 4 shows a top view and a sectional side view of a detail of a metal ring braiding.

FIG. 4 shows a top view and a corresponding sectional side view of a detail of the metal ring braiding 1, illustrating an example of the interlacing of rings 2. In the case of that interlacing of metal rings 2, groups of four interlaced metal rings 2 are connected by one welding point 4 producing a metallic material fit.

Welding is effected in this case by pressure welding. Other types of welding or soldering are of course likewise imaginable. The pressure welding process offers, however, a low-cost way of achieving a durable connection between any four interlaced metal rings 2 by a single welding point 4. If the metal ring braiding is placed on a bulging surface for welding, bulging structures can also be stiffened in this way so that the braiding can be adapted to the head or the shoulders of a person. This advantageously improves the wearing comfort.

Figure 5:
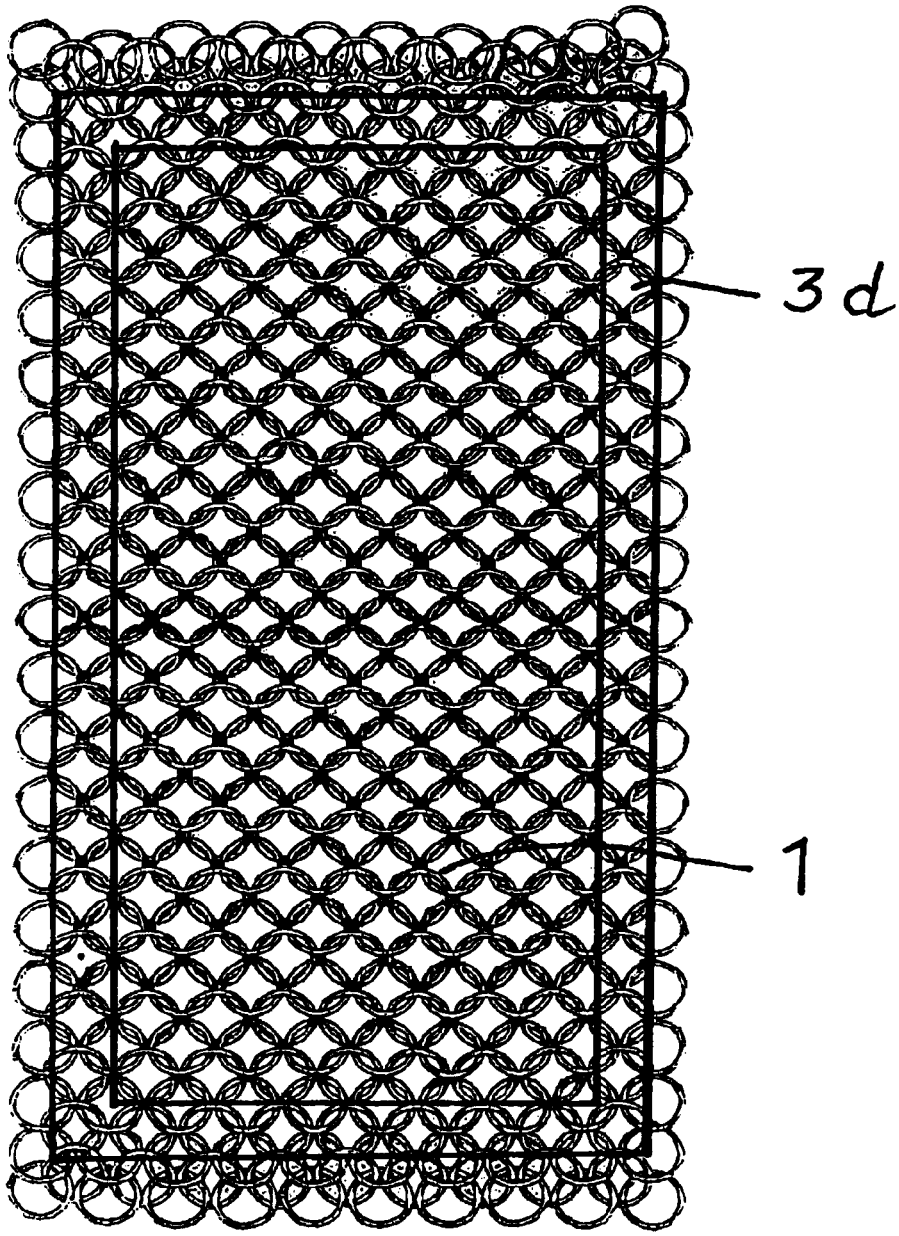
FIG. 5 shows a top view of a metal ring braiding with stabilisation for the outer contour.

FIG. 5 shows a metal ring braiding 1 with a stiffened section 3*d* serving as stabilisation for the outer contour. Advantageously, the outer contours are stiffened in this way while the inner area remains flexible, a solution which is favourable, for example, for aprons. Such stabilisation of the outer contour may be continuous, as shown in FIG. 5, or may exhibit interruptions.

What is claimed is:

1. Protective clothing comprising a metal ring braiding, wherein individual sections of the metal ring braiding are stiffened by interlaced rings interlinked by a solid metallic joint between the interlaced rings in the individual sections without the addition of further components to the protective clothing.

2. The protective clothing as defined in claim 1, wherein the metallic joint is produced by welding or soldering.

3. The protective clothing as defined in claim 1, wherein the metallic joint is produced by pressure welding.

4. The protective clothing as defined in claim 2 or 3, wherein each welding point connects four interlaced rings.

5. The protective clothing as defined in claim 1, wherein the stiffened sections have the shape of strips.

6. The protective clothing as defined in claim 5, wherein the strip-like sections extend approximately parallel to each other.

7. The protective clothing as defined in claim 5, wherein crossing strip-like sections are provide.

8. The protective clothing as defined in claim 1, wherein the dimensions of the stiffened sections is at least three times greater than an outer diameter of the rings of the metal ring braiding.

9. The protective clothing as defined in claim 1, wherein the stiffened sections are configured as interrupted strips.

10. The protective clothing as defined in claim 1, further comprising adjacent stiffened sections that do not cross each other, and the distance between adjacent stiffened sections, that do not cross each other, is greater than or equal to twice the outer diameter of the rings of the metal ring braiding.

11. The protective clothing as defined in claim 1, wherein the outer contours of the protective clothing are stiffened.

12. The protective clothing as defined in claim 1, wherein the stiffened sections act to stabilize bulging structures.

13. Protective clothing as defined in claim 1, wherein the clothing is intended to enclose arms or legs, and the stiffened sections extend substantially in the longitudinal direction of the arms or legs, respectively.

* * * * *